US008878728B1

(12) United States Patent
Livadaru et al.

(10) Patent No.: US 8,878,728 B1
(45) Date of Patent: Nov. 4, 2014

(54) PARASITIC ANTENNA ARRAY FOR MICROWAVE FREQUENCIES

(75) Inventors: Matilda G. Livadaru, Marion, IA (US); Lee M. Paulsen, Cedar Rapids, IA (US); Brian J. Herting, Marion, IA (US); James B. West, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 320 days.

(21) Appl. No.: 13/350,917

(22) Filed: Jan. 16, 2012

(51) Int. Cl.
*H01Q 1/38* (2006.01)

(52) U.S. Cl.
USPC ..... 343/700 MS

(58) Field of Classification Search
CPC ..... H01Q 1/38; H01Q 9/0407; H01Q 9/0421; H01Q 1/243; H01Q 5/00
USPC ..... 343/700 MS, 702
See application file for complete search history.

(56) References Cited

U.S. PATENT DOCUMENTS 6,407,719 B1 * 6/2002 Ohira et al. ..... 343/893
6,864,852 B2 * 3/2005 Chiang et al. ..... 343/817
7,106,270 B2 * 9/2006 Iigusa et al. ..... 343/833
7,176,844 B2 * 2/2007 Chiang et al. ..... 343/815
7,530,180 B2 * 5/2009 Chiang et al. ..... 343/702

* cited by examiner

*Primary Examiner* — Huedung Mancuso

(74) *Attorney, Agent, or Firm* — Donna P. Suchy; Daniel M. Barbieri

(57) ABSTRACT

The present invention includes a substrate; a central monopole element configured to radiate electromagnetic energy, the central monopole element disposed within a central monopole element through-hole of the substrate and extending from the first to the second surface of the substrate, the central monopole element formed by plating the central monopole element through-hole; a plurality of parasitic elements surrounding the central monopole element, each of the parasitic elements disposed within a parasitic element through-hole of the substrate and extending from the first to the second surface of the substrate, each of the plurality of parasitic elements formed by plating a parasitic element through-hole; a ground plane disposed on the second surface of the substrate; and a plurality of load circuits, each load circuit being connected to a parasitic element of the plurality of parasitic elements, each load circuit further being connected to the ground plane.

23 Claims, 8 Drawing Sheets

PARASITIC ANTENNA ARRAY FOR MICROWAVE FREQUENCIES

FIELD OF THE INVENTION

The present invention relates to the field of antenna technology and particularly to an improved microwave parasitic antenna array design and an improved microwave antenna array fabrication method.

BACKGROUND OF THE INVENTION

As the utilization of microwave antenna technology grows, it is desirable to produce an improved parasitic antenna array design and fabrication scheme. Currently existing parasitic antenna arrays consist of multiple parasitic pin elements arranged about a centrally located monopole pin element. The utilization of a variable reactance on one or more of the parasitic pins allows for the control of the RF load on each parasitic pin. In this manner, in a symmetric loading configuration, a parasitic antenna array may operate in an omnidirectional mode, with a monopole-like radiation pattern. In contrast, in an asymmetric loading configuration, a parasitic antenna array may operate in a directional mode. Presently available parasitic antenna arrays are capable of implementing variable reactance via a single component. For example, currently utilized parasitic array may implement the use of a PIN diode, a varactor diode, or a variable capacitor in order to provide a variable reactance to a parasitic pin of the given array.

Currently existing parasitic arrays are formed using a manual fabrication process. In this regard, the central monopole element and the multiple parasitic pins are typically attached to a substrate by hand. As such, present parasitic manufacturing processes are arduous, time consuming, expensive, and subject to producing less than optimum array features due to human error. It would therefore be desirable to provide a simplified parasitic array design and fabrication process that obviates the need for manual assembly, thereby reducing cost, time spent, and risk of error in the parasitic array fabrication process.

SUMMARY OF THE INVENTION

Accordingly, an embodiment of the present invention is directed to a parasitic antenna array, comprising: a substrate, the substrate including a first surface and a second surface disposed generally opposite the first surface; a central monopole element configured to radiate electromagnetic energy, the central monopole element being disposed within a central monopole element through-hole of the substrate and extending from the first surface of the substrate to the second surface of the substrate, the central monopole element formed by plating a portion of the substrate encompassing the central monopole element through-hole with a metallic material; a plurality of parasitic elements at least substantially surrounding the central monopole element, each of the plurality of parasitic elements being disposed within a parasitic element through-hole of the substrate and extending from the first surface of the substrate to the second surface of the substrate, each of the plurality of parasitic elements formed by plating a portion of the substrate encompassing a parasitic element through-hole with a metallic material; a ground plane, the ground plane disposed on the second surface of the substrate; and a plurality of load circuits, each load circuit being connected to one or more parasitic elements of the plurality of parasitic elements, each load circuit further being connected to the ground plane.

An additional embodiment of the present invention is directed to method for fabricating a parasitic antenna array, comprising: providing a substrate, the substrate including a first surface and a second surface disposed generally opposite the first surface; forming a central monopole element through-hole in the substrate extending from the first surface to the second surface of the substrate; forming a plurality of parasitic element through-holes in the substrate, each of the parasitic element through-holes extending from the first surface to the second surface of the substrate; forming a central monopole element by plating a portion of the substrate encompassing the central monopole element through-hole with a metallic material, the central monopole element configured to radiate electromagnetic energy, the central monopole element formed to extend from the first surface to the second surface of the substrate; forming a plurality of parasitic elements by plating each portion of the substrate encompassing a parasitic element through-hole with a metallic material, the plurality of parasitic elements formed such that the plurality of parasitic elements at least substantially surround the central monopole element, each of the parasitic elements formed to extend from the first surface of the substrate to the second surface of the substrate; providing a ground plane; connecting the ground plane to the second surface of the substrate; providing a plurality of load circuits; connecting each load circuit of the plurality of load circuits to one or more parasitic elements of the plurality of parasitic elements; and connecting each of the load circuits to the ground plane.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Referring generally to FIGS. 1A through 4C, a parasitic antenna array is described in accordance with the present disclosure. The present invention is directed to a parasitic antenna array having a plurality of parasitic elements 104 arranged about a centrally located monopole element 106. In one aspect, the central monopole element 106 of the parasitic antenna array 100 is formed by plating a central monopole element through-hole with a metallic material. In addition, the parasitic elements 104 of the antenna array 100 are formed by plating a set of parasitic element through-holes with a metallic material. In another aspect, the through-holes for both the central monopole element 106 and the plurality of parasitic elements 104 may be formed utilizing various drilling technologies. The utilization of a repeatable and automatable through-hole formation and plating processes provides a significant improvement over the parasitic array fabrication processes of the known art. The remainder of the present disclosure will focus on a parasitic array 100 as well as a process 600 of fabricating a parasitic array.

Figure 1A:
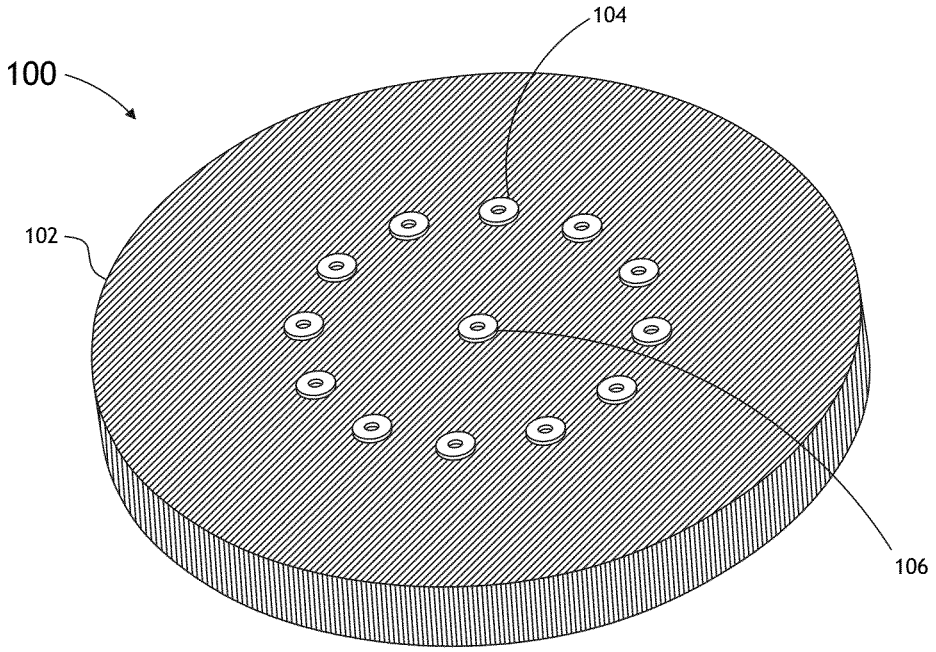
FIG. 1A is a schematic view of a parasitic antenna array in accordance with an embodiment of the present invention.
Figure 1B:
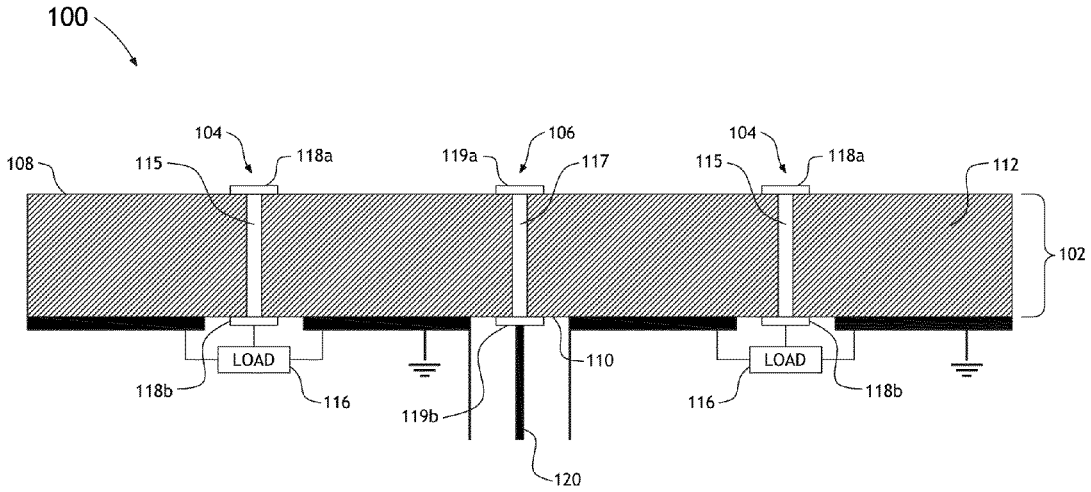
FIG. 1B is a schematic view of a parasitic antenna array in accordance with an embodiment of the present invention.
Figure 1C:
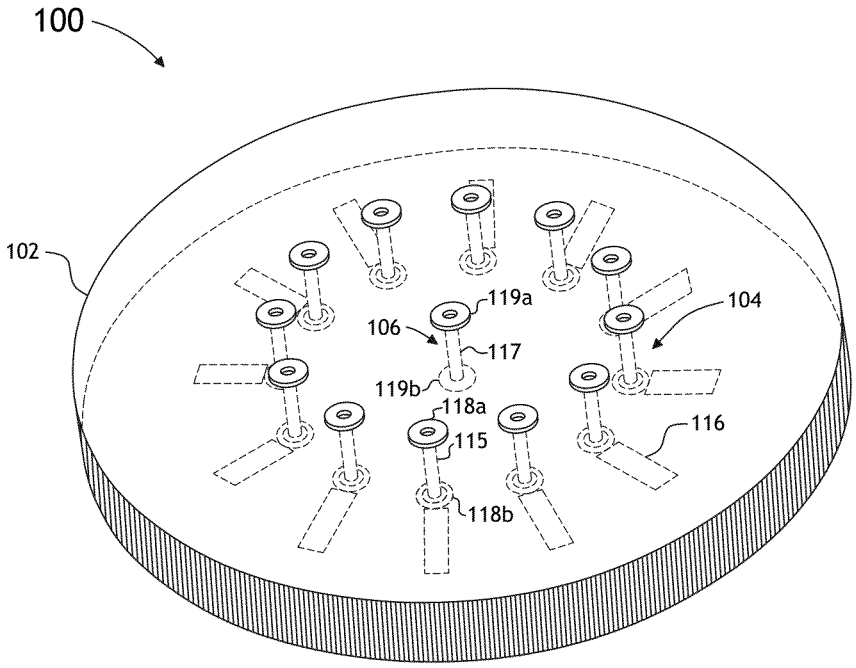
FIG. 1C is a schematic view of a parasitic antenna array in accordance with an embodiment of the present invention.

FIGS. 1A through 1C illustrate schematic views of the parasitic antenna array 100, in accordance with an exemplary embodiment of the present invention. In one aspect, the parasitic antenna array 100 may include a substrate 100. As shown in FIG. 1B, the substrate 102 may include a first surface 108 (e.g., a top surface) and a second surface (e.g., a bottom surface) 110 disposed generally opposite of the first surface 108. Those skilled in the art will recognize that the substrate 102 may be formed in a variety of shapes and sizes. As such, the disk shaped substrate 102 illustrated in FIGS. 1A-1C should not be interpreted as a limitation, but merely as an illustration. In one embodiment of the present invention, the substrate 102 may include, but is not limited to, a printed circuit board (PCB). For example, the substrate 102 may include a two-layer PCB. It should be recognized that any type of PCB may be suitable for implementation in the present invention. In an additional embodiment, the substrate may include 102 any dielectric substrate known in the art. For example, the substrate 102 may include a molded or machine dielectric substrate. For instance, the substrate 102 may include a dielectric substrate machined from Teflon.

In another aspect of the present invention, the parasitic antenna array 100 includes a central monopole element 106 (e.g., plated through-hole) disposed within the substrate 102. In a general sense, the central monopole element 106 may be disposed within the substrate 102 at a central region of the substrate 102. Those skilled in the art, however, will recognize that it is not a requirement of the present invention for the central monopole element 106 to be located at the central region of the substrate 102. In this regard, the Applicant notes that, in the context of the present invention, the central monopole element need only be surrounded by a plurality of parasitic array elements 104, discussed in more detail further herein. For example, although not shown, the central monopole element 106 may be arranged at an off-center location of the substrate 102. Those skilled in the art should recognize that the off-center location of the central monopole element 106 may be desirable in order to accommodate additional electrical or mechanical components on the substrate 102.

In another aspect of the present invention, the size (e.g., diameter) of the antenna substrate 102 may be approximately one wavelength of the radiation emitted by the antenna array 100. For example, in the case of Ku band radiation (12-18 Ghz), a substrate 102 may have a size (e.g., diameter) of approximately 1 to 3 cm.

In an additional aspect, the central monopole element 106 may consist of an omni-directional element 106 configured to radiate electromagnetic energy in an omni-directional radiation pattern (e.g., a monopole-like pattern). Further, the central element 106 may be configured for connection to a feed line (e.g., a Radio Frequency (RF) feed line). In this regard, the central monopole element 16 may receive a RF feed from the feedline (e.g., coaxial cable) and may radiate electromagnetic (EM) energy in an omni-directional radiation pattern.

In another aspect, the central monopole element 106 is formed by plating a central element through-hole of the substrate 102. In this regard, a central element through-hole may be formed by drilling (e.g., mechanical drilling or laser drilling) through the substrate 102. The through-hole may extend from the first surface 108 of the substrate to the second surface of the substrate 110. The central monopole element 106 may then be formed by plating the central element through-hole with a selected metallic material (e.g., copper).

As shown in FIGS. 1B and 1C, the plating of the central element through-hole of the substrate 102 may act to create a metal shaft 117, or barrel, extending from the first surface 108 of the substrate 102 to the second surface 110 of the substrate 102. The metallic shaft 117 may act as at least a portion of the central monopole element 106 of the parasitic antenna array 100. Those skilled in the art should recognize that the shaft 117 of the central monopole moment 106 may take on a variety of geometric shapes, such as, but not limited to, a cylinder, or a prismatoid (e.g., rectangular prism or hexagonal prism).

In another aspect of the present invention, the parasitic antenna array 100 may further include a plurality of parasitic elements 104 (e.g., plated through-holes). In the illustrated embodiment of FIGS. 1A and 1C, the parasitic antenna array 100 includes twelve parasitic elements 104. It is recognized herein, however, that varying numbers of parasitic elements 104 may be implemented in the parasitic antenna array 100 of the present invention. In this regard, the number of parasitic elements 104 selected for implementation may depend, in part, on the desired gain of the antenna array 100. As such, the number of parasitic elements 104 of the antenna array 100 of FIGS. 1A and 1C is not limiting and should be interpreted by those skilled in the art merely as an illustration.

In another aspect, the parasitic elements 104 of the parasitic array 100 are formed by plating multiple parasitic element through-holes of the substrate 102. As in the case of the central element through-hole, a parasitic element through-hole may be formed by drilling through the substrate 102. The through-hole may extend from the first surface 108 of the substrate to the second surface of the substrate 110. The parasitic elements 104 may then be formed by plating the parasitic element through-holes with a selected metallic material (e.g., copper).

As shown in FIGS. 1B and 1C, the plating of the central element through-hole of the substrate 102 may act to create a metal shaft 117, or barrel, extending from the first surface 108 of the substrate 102 to the second surface 110 of the substrate 102. The metallic shaft 117 may act as at least a portion of the central monopole element 106 of the parasitic antenna array 100. Those skilled in the art should recognize that the shaft 117 of the central monopole moment 106 may take on a variety of geometric shapes, such as, but not limited to, a cylinder, or a prismatoid (e.g., rectangular prism or hexagonal prism).

It is recognized herein that any metal plating technology (e.g., electroplating) may be utilized in order to plate the wall of the substrate 102 surrounding the central element through-hole or each of the parasitic element through-holes. It is contemplated herein that the fabrication process of the central element 106 and/or the parasitic elements 104 may include a fabrication process identical to or at least similar to the fabrication process utilized to form vias in PCB component fabrication.

In one embodiment of the present invention, as shown in FIGS. 1A-1C, the central monopole element 106 and all or some of the parasitic elements 104 may include an element pad attached at an end portion of the given element. For example, the central monopole element 106 may include a top element 119*a* and/or a bottom element 119*b* situated at the top end and bottom ends of the element 117 respectively. Likewise, each of the parasitic elements 104 may include a top element 118*a* and/or a bottom element 118*b* situated at the top end and bottom ends of the element 115 respectively.

In a further embodiment, the bottom elements 118*b* and 119*b* may be configured for connection with various electrical components. For example, the bottom pad 119*b* of the central monopole element 106 may be configured for connection with the RF feedline 120 or any other additional electrical components. By way of another example, the bottom pad 118*b* of each parasitic element 104 may be configured for connection with a portion of the load circuit 116. In this regard, the bottom pads 118*b* and 119*b* may function similar to PCB pads utilized to connect trace lines to a via, or plated through-hole, in a PCB based device.

In another embodiment, the top elements 118*a* and 119*a* may act to enhance tuning and/or bandwidth of the antenna array 100. In this regard, the particular size of the top element pads 118*b* and/or 119*b* may be selected in order to achieve a particular tuning level or bandwidth.

Figure 2:
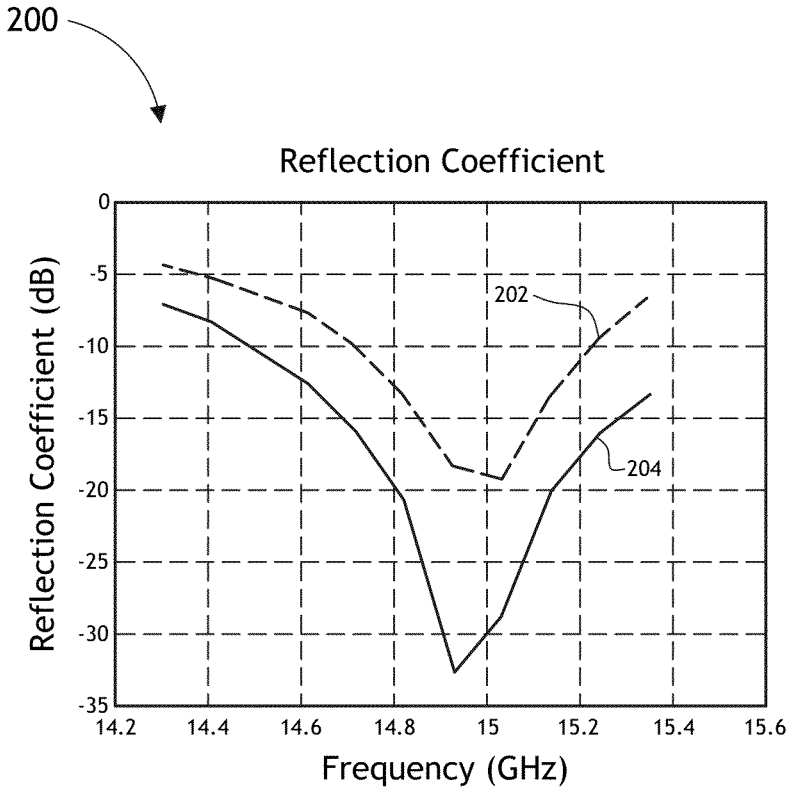
FIG. 2 is set of SII parameters measured as a function frequency for an array equipped with top element pads and an array without top element pads.

FIG. 2 illustrates a set of reflection coefficient data as a function of frequency for both a set of parasitic elements without top pads and a set of parasitic elements equipped with top pads. Data set 202 illustrates a reflection coefficient (e.g., S11 parameter) for the parasitic elements 104 having no top element structure. In contrast, the implementation of a top hat structure 118*a* improves the bandwidth of the array 100 as manifested in the reflection coefficient curve 204.

In one embodiment of the present invention, the parasitic elements 104 of the parasitic array 100 may be disposed within the substrate 102 and may be configured (e.g., oriented, arranged, located, or established) in a generally geometric pattern (e.g., circle, ellipse, or the like) so as to at least substantially surround the central monopole element 106. In this regard, the parasitic elements 104 may form a generally ring-like pattern, or circle, around the central monopole element 106 such that the central monopole element 106 is generally centrally located within the ring created by the plurality of parasitic elements 104. For example, as shown in FIGS. 1A and 1C, one ring of twelve parasitic elements 104 is established around the central monopole element 106.

Figure 3:
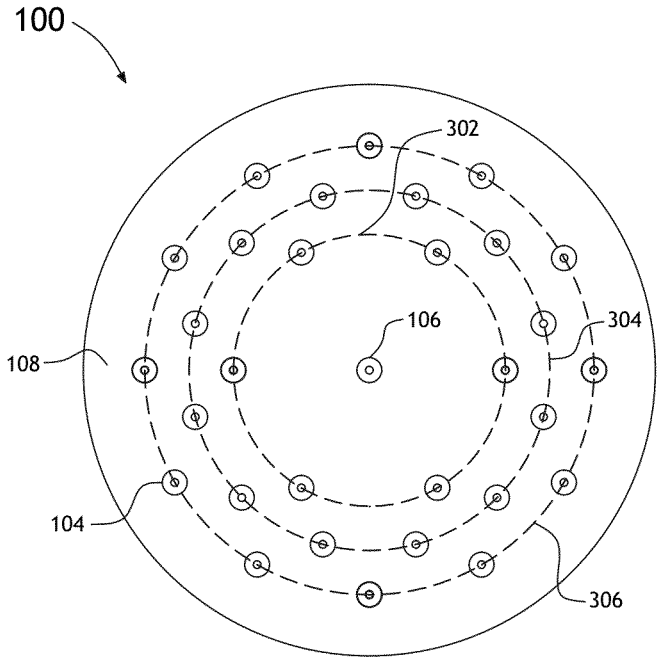
FIG. 3 is a top schematic view of a parasitic antenna array in accordance with an embodiment of the present invention.

FIG. 3 illustrates a parasitic antenna array 100 including multiple rings of parasitic elements 104, in accordance with an alternative embodiment of the present invention. As illustrated, multiple rings of parasitic elements 114 may be configured around the central monopole element 106. For example, ring 302, 304, and 306 may be concentrically arranged about the central monopole element 106. It is contemplated herein that multiple rings of parasitic elements 104 may be implemented in order increase the gain of the parasitic antenna array 100. As such, it is further contemplated that the overall number of parasitic elements 104 and the number of rings (e.g., 302, 304, and 306) implemented in a given parasitic array 100 may depend on the desired gain of a radiated beam of the array 100. Applicant further notes that the number of multiple rings illustrated in FIG. 3 is not limiting, and that FIG. 3 should be interpreted as merely illustrative. It is contemplated herein that the antenna array 100 of the present invention may include any suitable number of rings, up to and including "N" number of rings. Further, it is also contemplated that the antenna array 100 may include a variety of concentric geometric shapes and is not limited to concentric rings, or circles. For example, the antenna array 100 may include a series of concentric ellipses, squares, hexagons, octagons, and the like. In a general sense, a concentric series of any known geometric shape is considered within the context of this invention.

In another aspect of the present invention, a ground plane 114 may be connected to the second surface 110 (e.g., the bottom surface) of the substrate 102. It is recognized herein that the utilization of a ground plane 114 at the second surface 110 may act to improve the gain (e.g., azimuthal gain in a selected direction and horizon gain) of the antenna array. In one embodiment, a layer of conducting material, such as, but not limited to, copper may be deposited, affixed, attached or the like to the second surface 110 of the substrate 102. For instance, in the case where the substrate 102 consists of a PCB, any ground plane design and fabrication process known in the art of PCB construction is suitable for implementation in the context of the present invention.

In another aspect of the present invention, each parasitic element 104 of the parasitic antenna array 100 may be connected to a load circuit (e.g., a variable impedance load) 116. For example, as shown in FIG. 1C, each parasitic element 104 may have a corresponding load circuit 116 connected to a base portion of the parasitic element 104. In this regard, a load circuit 116 may be both mechanically and electrically coupled to the base portion of a parasitic element 104. For instance, the load circuit 116 may be electrically coupled to a parasitic element 104 via an element pad 118*b* formed at the base of the parasitic element 104. In the case of a PCB base substrate, the components of the load circuit 116 (discussed further herein) may be mechanically supported on a surface of the PCB substrate and electrically coupled to the parasitic element via the element pad 118*b*.

Figure 4A:
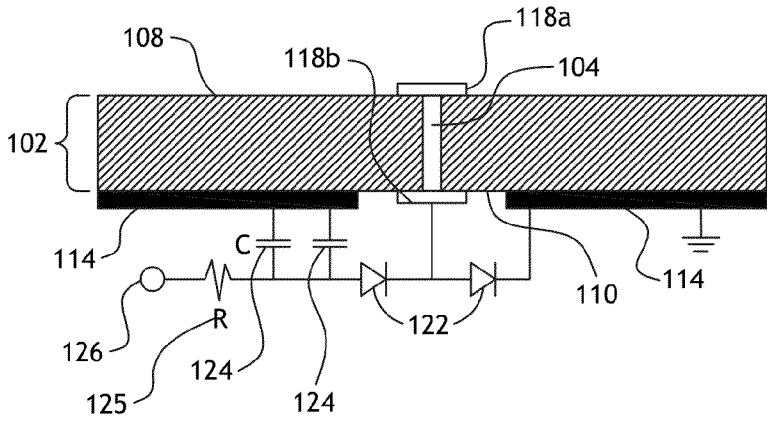
FIG. 4A is a schematic view of a load circuit connected to the substrate of the parasitic array in accordance with an embodiment of the present invention.

In further embodiments, each load circuit 116 may be connected (e.g., mechanically and electrically) to the ground plane 114 disposed on the second surface 110 (e.g., the bottom surface of the substrate 102 (as shown in FIG. 4A). Even further, each load circuit 116 may be an adjustable load circuit configured to provide an adjustable load to the given parasitic element 104.

FIG. 4A illustrates a parasitic element 104 connected to a corresponding load circuit 116, in accordance with one embodiment. In one embodiment of the present invention, the load circuit 116 may include a plurality of diodes 122. For example, the load circuit 116 may include two diodes 122, such as, but not limited to, two p-type, intrinsic, n-type (PIN) diodes 122. Further, the load circuit 116 may further include one or more capacitors 124. For instance, the one or more capacitors 124 are configured for connection to at least one of the PIN diodes 118. In addition, the load circuit 116 may further include a resistor 125. The resistor 125 may be configured for connection to at least one of the one or more capacitors 124. In further embodiments, the load circuit 116 may further include a Direct Current (DC) bias current source 126, the DC bias current source 124 configured for connection to the resistor 125.

In some embodiments of the present invention, the two PIN diodes 122 of the load circuit 116 may be configured for being connected to each other. Further, the load circuit's corresponding parasitic element 104 may be configured for connection to the two PIN diodes 122. Further, one of the two PIN diodes 122 may be configured to direct connect the parasitic element 104 to the ground plane 114, while the other of the two PIN diodes 118 may be configured to connect the parasitic element 104 to the ground plane 114 through one or more low impedance capacitors 124.

It is noted herein that the load circuit depicted in FIG. 4A is not limiting, but should merely be interpreted as an illustration. It is contemplated herein, for example, that pair of diodes illustrated in FIG. 4A may be replaced with a single diode (no shown). In this manner, the single diode base load circuit may be configured to operate analogously to the double diode load circuit illustrated in FIG. 4A.

In another embodiment of the present invention, the DC bias current source 126 may be configured to provide a DC bias current to the resistor 125. The DC bias current may be transmitted through (i.e., pass through) the resistor 125, thereby producing a voltage across the resistor 125. In a further embodiment, the resistor 125 and capacitor(s) 124 may form a low pass filter suitable for providing the DC bias current to the diodes 122. For example, upon radiation of electromagnetic energy by the monopole element 106, a parasitic element 104 may receive at least a portion of the electromagnetic energy. The electromagnetic energy (e.g., RF energy) may flow from the parasitic element 104 to a diode 122 of the load circuit 116 such that the RF energy may be shorted from the diode 122 directly to the ground plane 108 via the capacitor(s) 124. Further, the resistor 125 may be small and/or may be sized to set a desired current level for a desired voltage.

Figure 5:
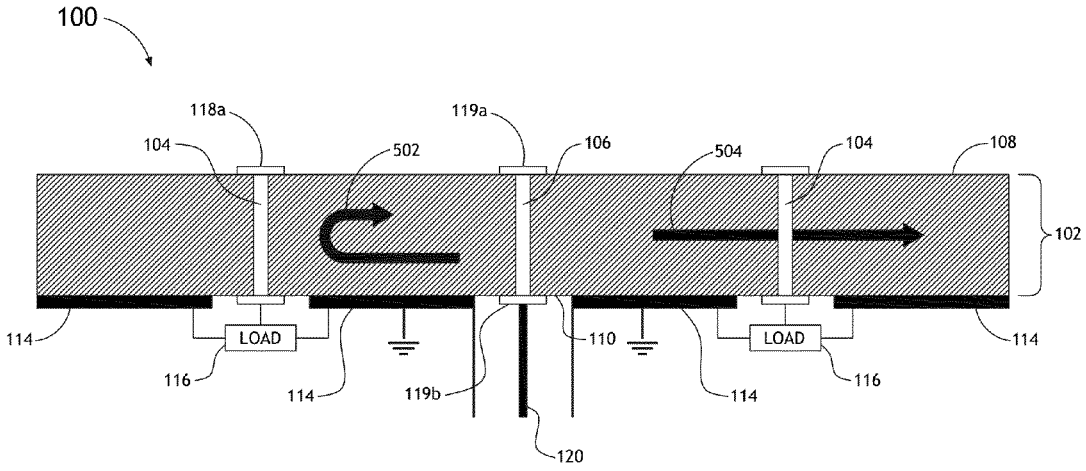
FIG. 5 is a block diagram schematic illustrating the operation of the parasitic antenna array in accordance with an embodiment of the present invention.

In another embodiment of the present invention, the load circuit 116 may be configured to provide a variable impedance (e.g., adjustable impedance) to the parasitic element 104 corresponding with the load circuit 116. As noted previously herein, the central monopole element 106 may be configured to receive RF energy from a feed line 112 (as shown in FIG. 1B). As shown in FIG. 5, based upon the received RF energy, the central monopole element 106 may be configured to radiate electromagnetic energy (e.g., electromagnetic waves 502 and 504) in multiple directions (e.g., towards various parasitic elements 104 of the array 100). The electromagnetic waves 502 and 504 may excite a voltage on multiple parasitic elements 104. The relationship between the voltage and current present on a particular parasitic element 104 of the array 100 may be determined by the impedance (Z) applied to that parasitic element 104 via its load circuit 116. For example, measured change in the voltage and current for the parasitic element 104 indicates that the applied impedance provided via the load circuit 116 for that parasitic element 114 has correspondingly changed. For instance, when the applied impedance provided to a parasitic element 104 via a corresponding load circuit 116 is low (i.e., low Z), the current on that parasitic element 104 is high (e.g., may be higher than the current present on the central monopole element 106), which in turn may cause the parasitic element 104 to reflect the electromagnetic wave 502 radiated by the central monopole 106 (as shown in FIG. 5). Additionally, when the applied impedance provided to a parasitic element 104 via its corresponding load circuit 116 is high (i.e., high Z), the current on that parasitic element 104 is low (e.g., may be lower than the current present on the monopole element 110), which in turn may cause the parasitic element 104 to be transparent to an electromagnetic wave 504 radiated by the central monopole element 106. In this regard, the parasitic element 104 may allow a wave radiated by the central monopole 106 to pass through it. It is recognized herein that the applied impedance provided to each parasitic element 104 via its corresponding load circuit 116 may be selectively varied for causing the parasitic antenna array 100 to control the omni-directional monopole field radiated by the monopole element 106 in order to radiate either multiple directional beams (e.g., azimuthal directional beams, one for each parasitic element of the array) or an omni-directional beam (e.g., a monopole-like radiation pattern). In this manner, it is recognized that the symmetric loading of impedances on the parasitic elements 104 of the parasitic array may be utilized in order to produce a monopole-like omni-directional beam, while the asymmetric loading of impedances on the parasitic elements 104 of the parasitic array may be implemented in order to produce multiple directional beams (e.g., azimuthal directional beams). It is further recognized that in a general sense the number of directional beams created may be equal to the number of parasitic elements 104 in a parasitic array 100.

The parasitic antenna array 100 of the present invention is configured for applying the variable impedance to the parasitic elements 104 (via the variable impedance loads 116) for causing the antenna array 100 to produce a desired radiation pattern, and, unlike currently available parasitic antenna arrays, the parasitic antenna array 100 of the present invention is configured for doing this efficiently even at high (e.g., 15 GHz) frequencies.

Figure 4B:
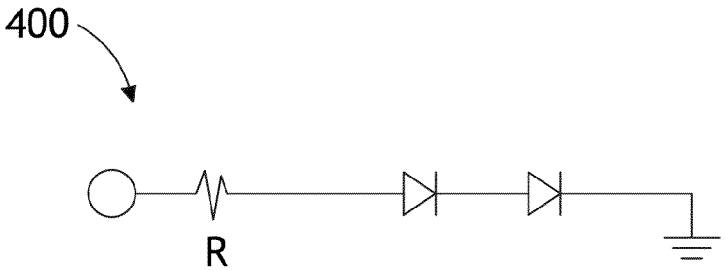
FIG. 4B is a block diagram schematic illustrating the operation of a load circuit when the parasitic antenna array is operating at low frequencies in accordance with a further embodiment of the present invention.
Figure 4C:
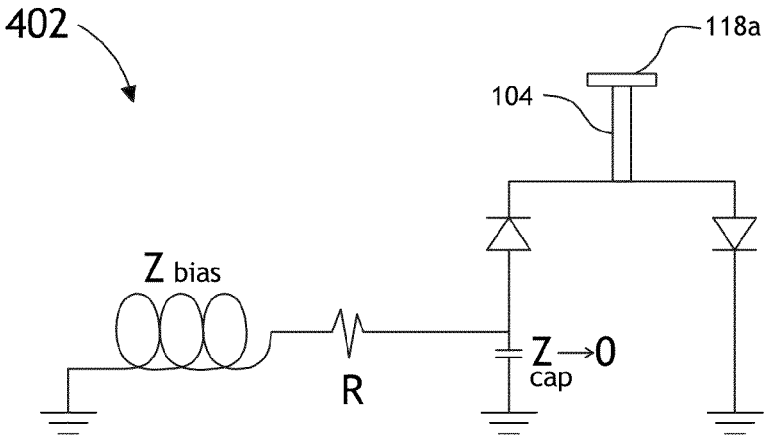
FIG. 4C is a block diagram schematic illustrating the operation of a load circuit when the parasitic antenna array is operating at high frequencies in accordance with a further embodiment of the present invention.

In another embodiment of the present invention, the diodes 122 of each load circuit 116 (e.g., load circuits shown in FIG. 4A) may control the RF load of each parasitic element 104, thereby affecting mutual coupling and reflectivity of the parasitic antenna array 100. In some embodiments of the present invention, in certain operation frequency regimes, the load circuit 116 may operate as a DC circuit 400 or an RF circuit 402. For instance, when the parasitic antenna array 100 is operating at lower frequencies (e.g., 3 GHz or below), each load circuit 116 may behave as a DC circuit 400 (as shown in FIG. 4B) in which the diodes 122 appear in series with one another, thereby allowing the total DC current draw to be the same as a load circuit which implements only a single diode. As noted previously herein, the parasitic antenna array 100 of the present invention is configured to apply a variable impedance to the parasitic elements 104 (e.g., via the variable impedance loads 116) in order to produce a desired radiation pattern, and is configured for doing this efficiently even at high (e.g., 15 GHz) frequencies. For instance, when the parasitic antenna array 100 is operating at higher frequencies (e.g., 15 GHz), each load circuit 116 may be configured to operate as an RF circuit 402 (as shown in FIG. 4C) in which the diodes 222 appear in parallel, with and any undesired impedance from the DC bias current source (e.g., DC bias circuit) 126 being shorted out by the parallel diode 122 coupled directly to ground 114. Such a configuration allows the parasitic antenna array 100 of the present invention to provide dramatically improved performance and efficiency at higher frequencies relative to currently available parasitic antenna arrays 100.

Those skilled in the art should recognize that the parasitic antenna array 100 of the present invention may provide improved RF and DC performance over previous parasitic antenna arrays because the parasitic antenna array 100 of the present invention does not require a biasing scheme dependent upon inductors (inductors may often be impractical and lossy at high frequencies), quarter wave matching sections (quarter wave matching sections may often be lossy and band limiting), or large blocking resistors (large blocking resistors may be impractical for current-controlled devices).

Further, the parasitic antenna array 100 of the present invention may be configured for usage at higher microwave frequencies, such as up to Ku band (e.g., 15 Gigahertz (GHz)). For example, the parasitic antenna array 100 of the present invention may exhibit a directional gain which is greater than 5 dBi (decibels (isotropic)) at 15 GHz. Further, the parasitic antenna array 100 of the present invention may be configured for omni-directional operation, mobile microwave Intelligence Surveillance Reconnaissance (ISR) data links (ex.—ISR applications), and/or Unmanned Aerial Vehicles (UAV) applications, hand-held applications, soldier platforms, Miniature Common Data Link (MiniCDL) applications, and/or Quint Networking Technology (QNT) applications. Still further, the parasitic antenna array 100 of the present invention may represent a significant size, weight, power and cost (SWAP-C) improvement (e.g., smaller SWAP-C, greater than 50 times size, weight and cost reduction) compared to currently available Ku band antennas (e.g., Intelligence Surveillance and Reconnaissance (ISR) Ku band antennas).

In addition, because the parasitic antenna array 100 of the present invention distributes thermal load across two devices (e.g., across two PIN diodes 122), the parasitic antenna array 100 of the present invention may provide improved power handling over currently available parasitic antenna arrays. Further, because the parasitic antenna array 100 of the exemplary embodiments of the present invention may dissipate power across multiple diodes 122, the parasitic antenna array 100 of the present invention may be configured for achieving higher power operation (e.g., greater than 20 Watts (>20 W)) than currently available parasitic antenna arrays.

In further embodiments of the present invention, all interconnects for the parasitic antenna array 100 may be engineered to be as short as possible, so as to remove any undesired impedances. Further, because the ground plane 114 of the parasitic antenna array 100 of the present invention is configured on the same side (e.g., the bottom surface 110) of the substrate 102 as the load circuit 116, this eliminates the need for the parasitic antenna array 100 of the present invention to have inductive vias. This is advantageous as inductive vias often add significant impedance at high frequencies.

In an additional embodiment of the present invention, large resistances may be placed in parallel with each diode 122 in order to balance the reverse bias voltage across the diodes 122, such as when the diodes 122 are not well-matched. The balancing of reverse bias voltage across the diodes 122 may be performed without significantly impacting RF performance.

It is noted herein that the above description of a load circuit designed to provide variable impedance to a parasitic element should not be interpreted as limiting, but merely as illustrative. In a general sense, any load circuit known in the art suitable for providing variable impedance to the parasitic elements 104 of the antenna array 100 are considered to be within the scope of the present invention. For example, other two-terminal variable impedance devices may include a varactor diodes or variable capacitor(s).

Figure 6:
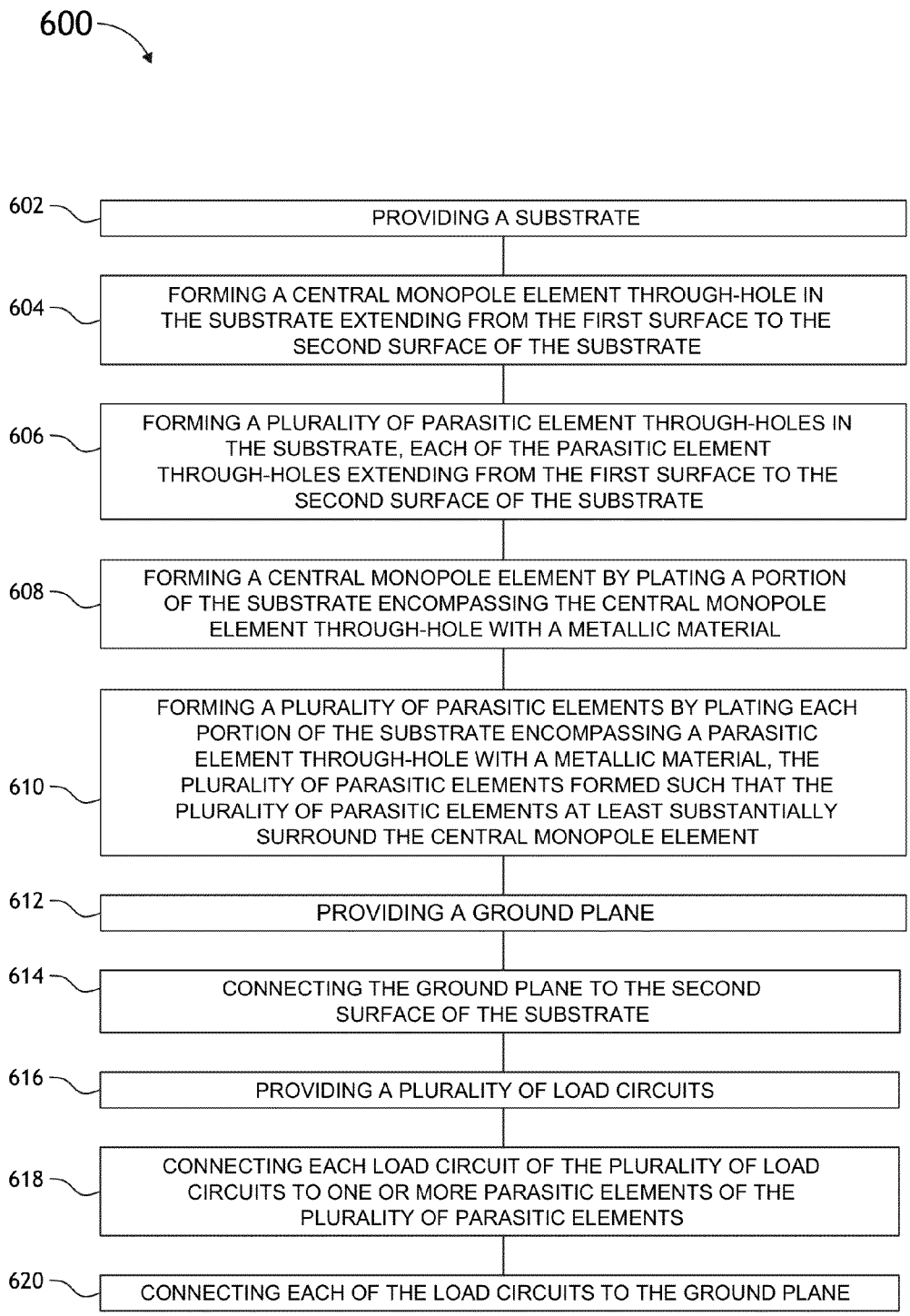
FIG. 6 depicts a flowchart illustrating a method of fabrication of the parasitic antenna array of the present invention, in accordance with an embodiment of the present invention.

FIG. 6 illustrates a flow diagram depicting a method of fabrication of the parasitic antenna array 100, in accordance with one embodiment of the present invention. Step 602 may provide a substrate. For example, the substrate may include a first surface and a second surface disposed generally opposite the first surface. By way of further example, the substrate 102 may include a printed circuit board (PCB) (e.g., two-layer PCB) or a machined dielectric substrate.

Step 604 may form a central monopole element through-hole in the substrate extending from the first surface to the second surface of the substrate. For example, a central element through-hole may be drilled through a center region of a PCB board. For instance, the central element through-hole may be drilled using a mechanical drill (e.g., tungsten-carbide drill) or a laser drill. In another example, the substrate 102 may be molded to include a through-hole at the center region of the substrate suitable for using as the central element through-hole.

Step 606 may form a plurality of parasitic element through-holes in the substrate, wherein each of the parasitic element through-holes extend from a first surface 108 of the substrate 102 to a second surface 110 of the substrate 102. For example, each of the parasitic element through-holes may be drilled through a PCB board in a manner such that the parasitic element through-holes generally surround the central monopole element through-hole. For instance, the parasitic element through-holes may be drilled using a mechanical drill (e.g., tungsten-carbide drill) or a laser drill. It is further contemplated herein that the central element through-hole and/or the plurality of parasitic element through-holes may be drilled sequentially or simultaneously utilizing a manual or automated drilling process. In another example, the substrate 102 may be molded to include a plurality of through-holes suitable for using as the parasitic element through-holes.

Step 608 may form a central monopole element by plating a portion of the substrate encompassing the central monopole element through-hole with a metallic material. In this regard, the central monopole element may be formed to extend from the first surface to the second surface of the substrate. For example, an electroplating process may be utilized in order to plate the interior of the central monopole element through-hole with a selected metal (e.g., copper). In this manner, a shaft 117 or barrel, suitable for operating as a central monopole element 106 of the antenna array 100, may be formed that extends from the first surface 108 to the second surface 110 of the substrate 102. In a further embodiment, the central monopole element may be configured to radiate electromagnetic energy in an omni-directional radiation pattern. For instance, upon receiving RF energy from the feedline 120, the central monopole element may radiate electromagnetic energy in an omni-directional radiation pattern.

In another embodiment, the central monopole element 106 may be formed to include an element pad (e.g., 119*a* or 119*b*) arranged at either the first surface 108 or the second surface 110 of the substrate. For example, a top element pad 119*a* may be arranged at the top end portion of the shaft 117 of the central monopole element 106. The top element pad 119*a* may be located such that it is disposed on the top surface 108 of the substrate 102. Applicants have found that the implementation of a top pad in the central monopole element 106 increases the level of tuning and increases bandwidth of the array 100. In another example, a bottom element pad 119*b* may be arranged at the bottom end portion of the shaft 117 of the central monopole element 106. For instance, the bottom element pad 119*b* may be coupled (e.g., mechanically and electrically) to the RF feedline 120.

Step 610 may form a plurality of parasitic elements by plating each portion of the substrate encompassing a parasitic element through-hole with a metallic material. In one embodiment, an electroplating process may be utilized in order to plate the interior of each parasitic element through-hole with a selected metal (e.g., copper). In this manner, a shaft 115 or barrel, suitable for operating as a parasitic array element 104 of the antenna array 100, may be formed that extends from the first surface 108 to the second surface 110 of the substrate 102. In a further embodiment, each of the parasitic elements 104 may be configured to selectively transmit or reflect electromagnetic waves emanating from the central monopole element 106 utilizing an associated load circuit 116, as discussed previously herein. In another embodiment, the parasitic elements may be formed such the parasitic elements 104 substantially surround the central monopole element 106. For example, the parasitic elements 104 may be formed about the central monopole element 106 in a pattern, such as a geometric pattern (e.g., circle, ellipse, hexagon, or the like). Even further, the parasitic elements 104 may be formed about the central monopole element 106 in a set of concentric geometric shapes (e.g., concentric circles, concentric ellipses, concentric hexagons, and the like).

In another embodiment, each of the parasitic elements 104 may be formed to include an element pad (e.g., 118*a* or 118*b*) arranged at either the first surface 108 or the second surface 110 of the substrate. For example, a top element pad 118*a* may be arranged at the top end portion of the shaft 115 of each parasitic element 104. The top element pad 118*a* may be located such that it is disposed on the top surface 108 of the substrate 102. Applicants have found that the implementation of a top pad on the parasitic elements 104 of the array increases the level of tuning and increases bandwidth of the array 100. It is noted herein that the particular size selected for the parasitic array elements 104 may be chosen to optimize (or attempt to optimize) the tuning level of the antenna array 100 and the bandwidth of the antenna 100. In another example, a bottom element pad 118*b* may be arranged at the bottom end portion of the shaft 115 of each parasitic element 104. For instance, the bottom element pad 119*b* may be coupled (e.g., mechanically and electrically) to the load circuit 116.

Step 612 may provide a ground plane. For example, the ground plane may include any ground plane known in the art suitable for implementation in a PCB and/or telecommunications applications. Step 614 may connect the ground plane 114 to the second surface 110 of the substrate 102. For example, the ground plane 114 may include a copper sheet or copper layer disposed (e.g., deposited, affixed, attached, soldered, and the like) on the second surface 110 of the substrate 102.

Step 616 may provide a plurality of load circuits (e.g., load circuit 116 or a single diode based load circuit). Step 618 may connect (e.g., mechanical coupling or electrical coupling) each load circuit 116 of the plurality of load circuits to one or more parasitic elements 104 of the plurality of parasitic elements. Step 620 may connect each of the load circuits 116 to the ground plane 114.

It is understood that the specific order or hierarchy of steps in the foregoing disclosed methods are examples of exemplary approaches. Based upon design preferences, it is understood that the specific order or hierarchy of steps in the method can be rearranged while remaining within the scope of the present invention. The accompanying method claims present elements of the various steps in a sample order, and are not meant to be limited to the specific order or hierarchy presented.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A parasitic antenna array, comprising:

a substrate, the substrate including a first surface and a second surface disposed generally opposite the first surface;

a central monopole element configured to radiate electromagnetic energy, the central monopole element being disposed within a central monopole element through-hole of the substrate and extending from the first surface of the substrate to the second surface of the substrate, the central monopole element formed by plating a portion of the substrate encompassing the central monopole element through-hole with a metallic material;

a plurality of parasitic elements at least substantially surrounding the central monopole element, each of the plurality of parasitic elements being disposed within a parasitic element through-hole of the substrate and extending from the first surface of the substrate to the second surface of the substrate, each of the plurality of parasitic elements formed by plating a portion of the substrate encompassing a parasitic element through-hole with a metallic material;

a ground plane, the ground plane disposed on the second surface of the substrate; and a plurality of load circuits, each load circuit being connected to one or more parasitic elements of the plurality of parasitic elements, each load circuit further being connected to the ground plane.

2. The parasitic antenna array of claim 1, wherein the substrate comprises at least one of a printed circuit board (PCB), a machined dielectric substrate, or a molded dielectric substrate.

3. The parasitic antenna array of claim 1, wherein the central monopole element is configured to radiate electromagnetic energy in an omni-directional radiation pattern.

4. The parasitic antenna array of claim 1, wherein the central monopole element includes an element pad arranged at an end portion of the central monopole element.

5. The parasitic antenna array of claim 1, wherein each of the plurality of parasitic elements includes an element pad arranged at an end portion of the parasitic element.

6. The parasitic antenna array of claim 5, wherein each of the element pads has a selected size, the size of each of the element pads selected in order to provide at least one of a selected tuning level or a selected bandwidth of the antenna array.

7. The parasitic antenna array of claim 1, wherein the central monopole element and the plurality of parasitic elements are configured to at least one of operate at a frequency below 12 GHz, operate at a frequency between 12 GHz and 18 GHz, or operate at a frequency above 12 GHz.

8. The parasitic antenna array of claim 1, further comprising:

a feed line, the feed line being connected to the central monopole element, the feed line configured to provide RF energy to the central monopole element.

9. The parasitic antenna array of claim 1, wherein the plurality of load circuits is configured to provide at least one of symmetric loading or asymmetric loading to the plurality of parasitic elements.

10. The parasitic antenna array of claim 1, wherein a load circuit of the plurality of load circuits is connected to a base of a parasitic element included in the plurality of parasitic elements.

11. The parasitic antenna array of claim 1, wherein the load circuit is configured to provide an impedance to the parasitic element.

12. The parasitic antenna array of claim 11, wherein the provided impedance is adjustable.

13. The parasitic antenna array of claim 12, wherein the parasitic element is selectively configurable, based upon the impedance provided to the parasitic element by the load circuit, for one of: reflecting the electromagnetic energy radiated from the monopole element; or transmitting electromagnetic energy radiated from the monopole element through the parasitic element.

14. The parasitic antenna array of claim 11, wherein the load circuit comprises:

a DC bias current source;

a resistor, the resistor configured for connection to the DC bias current source;

one or more capacitors, the one or more capacitors configured for connection to the resistor; and one or more diodes, the one or more diodes configured for connection to a parasitic element of the parasitic antenna array, the one or more diodes configured to connect the parasitic element to a ground plane of the parasitic antenna array.

15. The parasitic antenna array of claim 14, wherein the one or more diodes comprise:

a single diode configured for connection to a parasitic element of the parasitic antenna array, the single diode configured to connect the parasitic element to a ground plane of the parasitic antenna array.

16. The parasitic antenna array of claim 14, wherein the one or more diodes comprise:

a plurality of diodes, the plurality of diodes configured for connection to a parasitic element of the parasitic antenna array, a first diode included in the plurality of diodes being configured to directly connect the parasitic element to a ground plane of the parasitic antenna array, a second diode included in the plurality of diodes being configured to connect the parasitic element to the ground plane via the one or more capacitors.

17. The parasitic antenna array of claim 14, wherein the load circuit is configured to short RF energy from the one or more diodes directly to the ground plane via the one or more capacitors.

18. A method for fabricating a parasitic antenna array, comprising:

providing a substrate, the substrate including a first surface and a second surface disposed generally opposite the first surface;

forming a central monopole element through-hole in the substrate extending from the first surface to the second surface of the substrate;

forming a plurality of parasitic element through-holes in the substrate, each of the parasitic element through-holes extending from the first surface to the second surface of the substrate;

forming a central monopole element by plating a portion of the substrate encompassing the central monopole element through-hole with a metallic material, the central monopole element configured to radiate electromagnetic energy, the central monopole element formed to extend from the first surface to the second surface of the substrate;

forming a plurality of parasitic elements by plating each portion of the substrate encompassing a parasitic element through-hole with a metallic material, the plurality of parasitic elements formed such that the plurality of parasitic elements at least substantially surround the central monopole element, each of the parasitic elements formed to extend from the first surface of the substrate to the second surface of the substrate;

providing a ground plane;

connecting the ground plane to the second surface of the substrate;

providing a plurality of load circuits;

connecting each load circuit of the plurality of load circuits to one or more parasitic elements of the plurality of parasitic elements; and connecting each of the load circuits to the ground plane.

19. The method for fabricating a parasitic antenna array of claim 18, wherein at least one of the forming a central monopole element through-hole in the substrate or the forming a plurality of parasitic element through-holes in the substrate comprises:

drilling a hole through the substrate.

20. The method for fabricating a parasitic antenna array of claim 18, wherein the plating a portion of the substrate encompassing the central monopole element through-hole with a metallic material comprises:

electroplating the portion of the substrate encompassing the central monopole element through-hole with a metallic material.

21. The method for fabricating a parasitic antenna array of claim 18, wherein the plating each portion of the substrate encompassing a parasitic element through-hole with a metallic material comprises:

electroplating each portion of the substrate encompassing a parasitic element through-hole with a metallic material.

22. The method for fabricating a parasitic antenna array of claim 18, wherein the forming a central monopole element comprises:

forming a central monopole element having an element pad arranged at one or more end portions of the central monopole element.

23. The method for fabricating a parasitic antenna array of claim 18, wherein the forming a plurality of parasitic elements comprises:

forming a plurality of parasitic elements, wherein some of the parasitic elements include an element pad arranged at one or more end portions of the parasitic element.

* * * * *